US006674042B1

(12) United States Patent
Walder et al.

(10) Patent No.: US 6,674,042 B1
(45) Date of Patent: Jan. 6, 2004

(54) METHOD AND DEVICE FOR FORMING POROUS METAL PARTS BY SINTERING

(75) Inventors: Andre Walder, L'Hay les Roses (FR); Brigitte Martin, Saint Genis Laval (FR)

(73) Assignees: Renault SAS, Boulogne Billancourt (FR); ONERA (Office Nationale d'Etudes et de Recherches aerospatiales), Chatillon (FR); Arvin Exhaust SA, Joigny (FR); Gervois SA, Pont Remy (FR)

( * ) Notice: Subject to any disclaimer, the term of this patent is extended or adjusted under 35 U.S.C. 154(b) by 0 days.

(21) Appl. No.: 09/979,063

(22) PCT Filed: May 19, 2000

(86) PCT No.: PCT/FR00/01362

§ 371 (c)(1),
(2), (4) Date: Mar. 1, 2002

(87) PCT Pub. No.: WO00/71284

PCT Pub. Date: Nov. 30, 2000

(30) Foreign Application Priority Data

May 21, 1999 (FR) ..... 99 06462

(51) Int. Cl.[7] ..... B23K 11/00

(52) U.S. Cl. ..... 219/78.01; 219/85.22; 219/117.1

(58) Field of Search ..... 219/78.01, 86.1, 219/85.22, 117.1, 85.13, 85.16, 78.16, 108, 119

(56) References Cited

U.S. PATENT DOCUMENTS

| | | | | |
|---|---|---|---|---|
| 3,670,137 A | * | 6/1972 | Inoue | 219/76 |
| 3,769,086 A | * | 10/1973 | Schladitz | 117/228 |
| 3,873,805 A | * | 3/1975 | Inoue | 219/149 |
| 4,163,173 A | * | 7/1979 | Norling | 313/352 |
| 4,829,152 A | * | 5/1989 | Rostoker et al. | 219/78.02 |
| 5,246,638 A | * | 9/1993 | Goldberger | 264/27 |
| 5,487,771 A | * | 1/1996 | Zeller | 55/523 |
| 5,518,833 A | * | 5/1996 | Repplinger et al. | 429/59 |
| 5,679,441 A | | 10/1997 | Saelens et al. | |

FOREIGN PATENT DOCUMENTS

| | | |
|---|---|---|
| FR | 1 506 994 | 2/1968 |
| FR | 2 341 949 | 9/1977 |
| GB | 1 455 705 | 11/1976 |

* cited by examiner

*Primary Examiner*—M. Alexandra Elve
(74) *Attorney, Agent, or Firm*—Young & Thompson

(57) ABSTRACT

A process for forming metal components of controlled porosity by welding, in which a predetermined amount of metal elements (50) of oblong shape is introduced into a mold (10) in which it is distributed isotropically. The metal elements are then subjected to increasing pressure (P) until the component has its final shape. The walls of the mold are then held in position and an electric current (I) flows through the metal elements and welds them together by local melting at the points of contact due to the Joule effect.

8 Claims, 2 Drawing Sheets

METHOD AND DEVICE FOR FORMING POROUS METAL PARTS BY SINTERING

BACKGROUND OF THE INVENTION

The present invention relates to the production of components by welding. The invention relates more particularly to a process for welding metal fiber by capacitor discharge in order to produce components of required shape.

DESCRIPTION OF THE RELATED ART

Existing capacitor discharge welding processes are known (GB 1 508 350). These processes consist in passing a current, generally obtained by discharging a capacitor, through particles of metallic material so as to weld them together. These processes have been applied to powders of spherical particles (P. A. Vityaz et al, "Contact formation during the electric pulse sintering of a titanium alloy powder", Belorussian Republican Powder Metallurgy Scientific Production Association, translated by Poroshkovaya Metallurgiya, No. 7 (331), pages 20–23, July 1990) or of elongate particles such as fibers (S. T. S. Al Hassani et al, "Preforming using high-voltage electrical discharge", Powder Metallurgy, No. 1, page 45, 1980).

These processes have sometimes also been combined with the application of pressure (R. W. Boesel et al, "Spark sintering tames exotic P/M materials", Materials Engineering, page 32, October 1969), so as to facilitate the welding and eliminate as far as possible the porosity of the components thus welded. These components are compact and their level of porosity is close to 0 (if Vm is the volume of material and Vc is the volume of the finished component, the degree of porosity $\tau$ is defined as $\tau=1-(Vm/Vc)$).

SUMMARY OF THE INVENTION

In contrast, the disclosed invention is aimed at the manufacture of porous components. These components may, for example, be supports for an active material, such as the fibrous structures for catalytic converters.

It is necessary for these components to have a very high level of porosity, allied with excellent mechanical strength over a wide temperature range.

The desired levels of porosity start from 0.60 and typically are in the region of 0.95. The level varies according to the shape and the function of the components to be produced.

Finally, the manufacture of these components must also be controlled so as to achieve good reproducibility with precise dimensions.

This type of application therefore produces specific problems to which the process of the invention and the apparatus for implementing it prove a solution.

The invention is a process for forming metal components of controlled porosity by welding, comprising the known successive steps consisting of:

preparing a predetermined amount of metal elements of anistropic geometrical shape, intended for constituting a component;

distributing this predetermined amount of metal elements in a mold having at least one movable part;

exerting pressure using a movable part of the mold controlled by an external means, which movable part possibly constituting an electrode, in at least one main direction on this predetermined amount of metal elements, said pressure being intended to reinforce and maintain the points of contact between these elements;

simultaneously passing an electric current through this predetermined amount of metal elements via a set of two electrodes of opposite polarity in order to join these metal elements together by welding, said two electrodes being placed so that the direction of flow of the current is overall coaxial with said main direction of the pressure exerted on the predetermined amount of metal elements; and removing the component from the mold.

The expression "elements of anisotropic geometrical shape" is understood to mean articles having at least one of the three dimensions significantly different from the other or others.

The process of the invention is characterized in that:

the predetermined amount of metal elements is obtained by weighing a mass of metal elements whose value M is defined as a function of the desired degree of porosity $\tau$, the volume of the component Vc and the density of the metal alloy used $\rho a$ by the formula:

$$M=VC\ \rho a(1-\tau)$$

the predetermined amount of metal elements is distributed isotropically in the mold;

the pressure exerted is progressively increased until the component has the required shape, thus giving the component the desired level of porosity; and the movable part of the mold is then held in position and, simultaneously, the electric current flows through the metal elements and welds them together by local melting at the points of contact due to the Joule effect or by creation of a local arc.

The expression "local melting at the points of contact" is understood to mean melting relating to only part of each of the cross sections in three dimensions of the metal elements. This melting is such that, on the one hand, the mechanical strength of each metal element in question, although momentarily reduced, remains sufficient for all of these elements to retain the shape acquired during the previous step, thus retaining the isotropic distribution in the mold, and, on the other hand, the mechanical strength of the component is optimal for the use.

The elements of anisotropic geometrical shape of the invention preferably have one dimension significantly different from the other two. They are therefore generally oblong and advantageously are in the form of needles, flakes or nonwoven fibers.

It is very desirable for easy implementation of the process for the elements to distribute themselves spontaneously in an isotropic manner in the mold. Elements of approximately cubic or spherical shape for example distribute themselves spontaneously in an isotropic manner in a mold. However, these elements are not anisotropic. Their use in the process of the invention does not allow the desired level of porosity to be achieved ($\tau max=0.5$ in the case of tubes and 0.48 in the case of spheres).

However, elements having both an anisotropic geometrical shape and the ability to distribute themselves spontaneously in an isotropic manner in a mold do exist. Such elements are obtained in particular by the technique of casting on a wheel. In fact, the elements produced using this technique have, among other characteristics, the particular feature of having surface asperities, mainly on the edges parallel to the significantly different dimension. These asperities prevent the elements from sliding against one another and thus prevent them from being distributed anisotropically under the effect of gravity.

Thus, they distribute themselves isotropically in the mold without any further manipulation such as, for example, shaking them. The level of porosity spontaneously obtained may be up to 0.99, which value may be greater than that of the desired level of porosity. To maintain the isotropic character of the fiber distribution in the component, the spontaneous level of porosity must remain close to that desired. For this purpose, the metal elements may be ground or chopped beforehand so as to size them according to the significantly different dimension with a suitable value.

It is therefore by applying pressure to the metal elements by means of a movable part of the mold that the required shape is given to the component and, likewise, the desired level of porosity. The applied pressure progressively increases up to the necessary value so that the movable part of the mold reaches the position corresponding to the required shape. There is therefore a balance between the force exerted by the external means and the elastic reaction force from the compressed elements.

The movable part is then held in position. It should be understood by this that the movable part of the mold can no longer change position, even if the reaction force exerted by the compressed elements suddenly varies.

This is because, when the electric current flows through the metal elements, the local melting causes the force exerted by these elements on the movable part of the mold to suddenly be decreased. If the force from the external means is kept constant and if the movable part is left free in position, this results in strong compression and deformation of the component owing to the imbalance in the forces.

With the movable part held in position, it is necessary to deliver an electric current flowing through the metal elements such that it allows local melting, as defined above, but without causing complete melting at the contact points, this melting being defined as melting over the entire cross section of the metal elements. This is because, if the current delivered is too high, complete melting of many elements takes place and, by gravity, this results in deformation of the component.

The electric current thus controlled is advantageously delivered by an electrical generator using a capacitor of capacitance C, which constitutes an economic, simple and well-suited means for this type of application.

The apparatus according to the invention comprises a set of electrodes, at least one of which is fastened to a movable wall.

BRIEF DESCRIPTION OF THE DRAWINGS

The process according to the invention will be more clearly understood from the detailed, but non-limiting, description of several methods of implementing it and with the aid of the references to the appended drawings in which.

DESCRIPTION OF THE PREFERRED EMBODIMENTS

Figure 1:
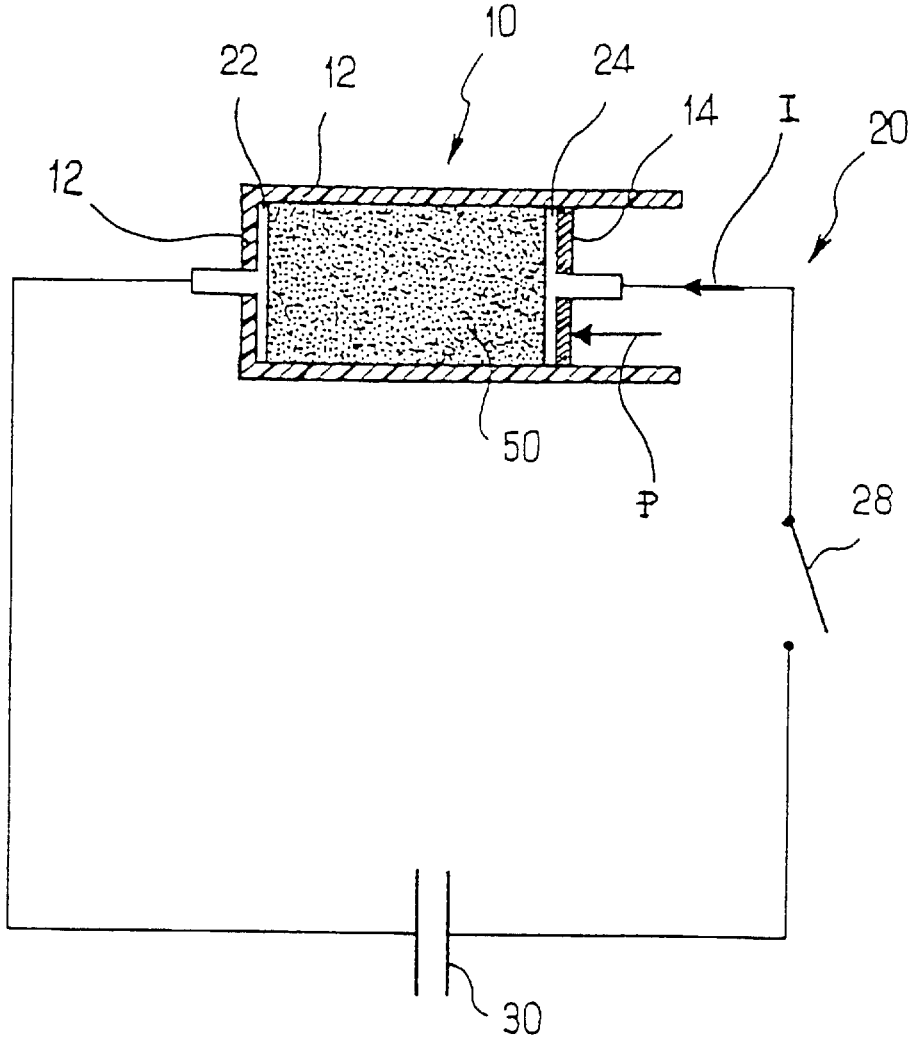
FIG. 1 shows schematically a sectional view of an apparatus having one movable wall according to the invention, implementing the process.

The apparatus in FIG. 1 allows the process according to the invention to be implemented. It comprises a mold 10 and an electrical circuit 20.

The mold 10 consists of fixed walls 12 and a movable wall 14. The fixed walls together form a space open at one end, a predetermined amount of metal elements 50, for example fibers, being placed inside said space.

The movable wall 14 closes this space, holding the metal fibers 50, but can slide parallel to itself in the closed space by an external means (not shown) so as to be able to apply to the fibers the pressure P needed to obtain the desired level of porosity. When this level is reached, the component has the required shape and the movable wall is then stopped. The external means employed may, for example, be an actuator servocontrolled in terms of force and then of position.

The electric circuit 20 comprises a switch 28, a capacitor 30 and a set of electrodes 22, 24, assumed to have no thickness. There are complementary means for controlling the intensity of the current I and the circuit for charging the capacitor, which defines the voltage V across the terminals of the capacitor, but these have not been shown.

Each of the opposed movable wall 14 and fixed wall 12 is equipped with an electrode, 24 and 22 respectively, which is connected to one of the terminals of the capacitor 30, one of which is connected via the switch 28.

A component is produced with fibers, obtained by a process for casting them on a wheel, in the following manner.

The required component has the shape of a cylinder with a circular base 7.5 cm in diameter, a height of 10 cm and a level of porosity of 0.95. The metal alloy used has a density of 7.1 g/cm3.

The fibers have a crescent-shaped cross section falling within an approximately 100 $\mu$m by 500 $\mu$m rectangle and have a length of about 5 cm.

The predetermined amount of fibers has a mass M=0.157 kg. The mold 10 has a fixed wall 12 consisting of an end wall supporting a circular electrode, having an inside diameter of 7.5 cm, and a cylindrical shell, having an inside diameter also of 7.5 cm and a length of more than 10 cm. The amount of fibers is introduced into the mold 10. The fibers distribute themselves spontaneously in an isotropic manner in the mold, with a level of porosity greater than 0.95. The movable wall 14, supporting a circular electrode 24 having a diameter very close to 7.5 cm, is then introduced into the cylindrical shell and, under the action of the external means, compresses the fibers until the distance between the movable wall 14 and the opposite fixed wall 12 becomes 10 cm. The movable wall 14 is then held in this position. The component has the required shape and the desired level of porosity. The switch 28 is then closed, causing the electric current to flow through the fibers 50. The capacitor, precharged by a voltage of 19 kV, has a capacitance of 106 $\mu$F. The energy thus used for the welding is 20 kJ. The mold is then opened by retracting the movable wall 14 and the component is removed from the mold.

None of these operations requires preheating the fibers to a particular temperature or the presence of a particular gaseous atmosphere, although, in a known manner, the presence of an inert gas such as argon is favorable. The process is therefore simple and rapidly implemented, the time needed to recharge the capacitor being carried out in parallel with the step of removing the component, the step of distributing the fibers in the mold and the compression step.

Figure 2:
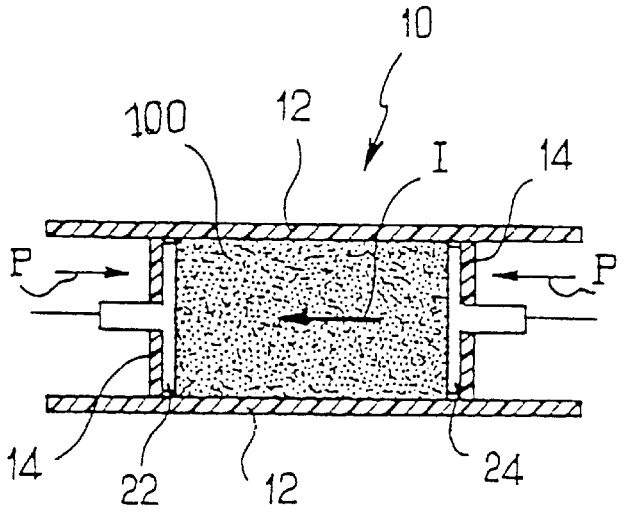
FIG. 2 shows schematically a sectional view of another apparatus, having two movable walls, with the component having the required shape.

FIG. 2 shows an alternative embodiment in which the electrodes are supported by two opposed movable walls 14. The main benefit of this apparatus resides in the easier handling of the component 100 after welding. Each movable wall 14 closes one end of the open space bounded by the fixed wall 12, holding the metal fibers 50 in place, but can slide parallel to itself in the closed space by an external means (not shown), so as to be able to apply to the fibers the pressure P needed to obtain the desired level of porosity. The external means used for each movable wall may, for example, be an actuator servocontrolled in terms of force and then of position.

The preferred method of implementing the process according to the invention may be optimized by taking into account the results described below. In this part of the description, the parameter used is expressed as energy per unit area (kJ/cm2). The area involved is the cross section of the component in a plane perpendicular to the direction of flow of the current. For a given apparatus, this parameter is a function of the current employed on discharging the capacitor, even if some of the energy delivered is consumed outside the component to be welded.

It has been shown that, in order to obtain components 100 consisting of metal fibers whose porosity is approximately 95%, it is necessary to dissipate a minimum energy of 0.1 kJ/cm2. Below this value, there is insufficient welding together of the fibers.

Figure 3:
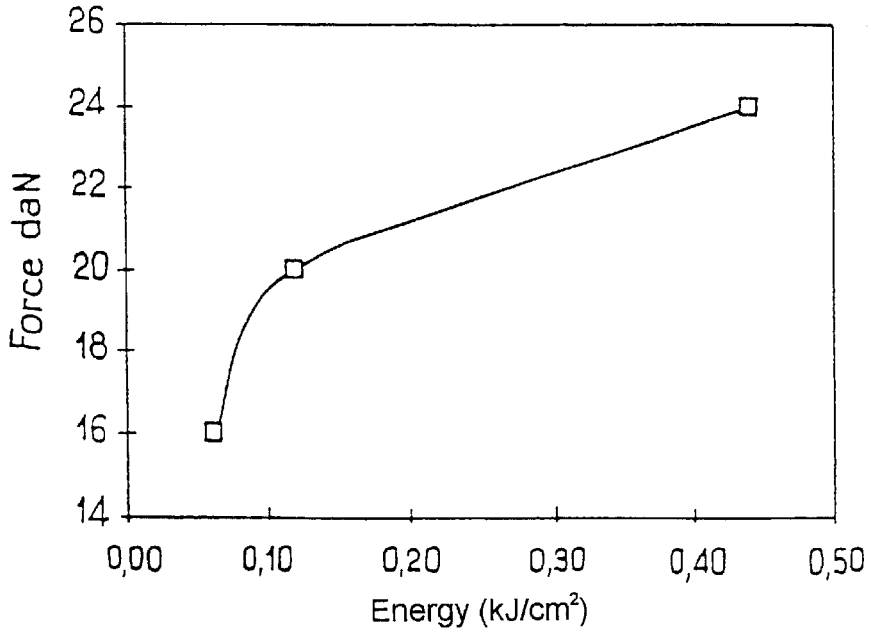
FIG. 3 is a diagram showing the mechanical strength of a particular component obtained by implementing the present invention as a function of the electrical energy dissipated to form this component.

This result was obtained by subjecting control fibrous components 100 (average diameter 23 mm) to discharges from the capacitor 30 of increasing energy. Measurement of the quality of the weld, and therefore of the mechanical strength of the components 100, was carried out by tensile tests. Attached heads made of curable resin were fitted onto each end of these components 100 in order to allow them to be gripped in the jaws. FIG. 3 shows the variation in mechanical strength in daN as a function of the energy per unit area (kJ/cm2). It may be seen that the mechanical strength increases with increasing energy per unit area, but tends to flatten out above 0.1 kJ/cm2. Experiments have shown that above 0.5 kJ/cm2, for a porosity of about 95%, there is excessive melting of the fibers resulting in excess energy.

Moreover, the energy E stored in a capacitor 30 is given by the expression E=½ CV2, where E is in joules, the capacitance C of the capacitor is in farads and the voltage V applied to the capacitor 30 is in volts. A given energy level may therefore be obtained by varying the capacitance or the voltage.

Fibrous components 100 (diameter 75 mm, length 100 mm, cross section 44 cm2, porosity 95%) were welded with a constant energy of 20 kJ (0.45 kJ/cm2) for two capacitances, 74 $\mu$F (23 kV) and 106 $\mu$F (19 kV). Measurement of the quality of the weld, and therefore of the mechanical strength of the components, was carried out, as previously, by tensile tests.

The results are given in table I below, in which it may be seen that the maximum force, expressed in daN, is obtained for the higher capacitance (106 $\mu$F), and therefore the lower voltage (19 kV). Three tests were carried out per condition.

TABLE I

| | Capacitance | |
|---|---|---|
| E = 20 kJ | 74 $\mu$F | 106 $\mu$F |
| Voltage (kV) | 23 | 19 |
| Maximum | 24 | 52 |
| tensile force | 29 | 57 |
| (daN) | 25 | 58 |

For the 106 $\mu$F capacitance, the increase in the energy stored in the capacitor 30, and therefore dissipated in the components 100 upon discharge, increases up to 70 kJ (36 kV, 1.6 kJ/cm2).

The degree of melting of the fibers 50 was seen to increase, becoming very significant at 70 kJ and, to some extent, impairing the initial fibrous structure. The tensile tests on the components 100 obtained (table II below) no longer show an increase in the mechanical strength.

TABLE II

| | Energy (kJ) | | | |
|---|---|---|---|---|
| | 20 | 50 | 60 | 70 |
| Energy per unit area (kJ/cm2) | 0.45 | 1.14 | 1.36 | 1.59 |
| Voltage (kV) | 19 | 31 | 34 | 36 |
| Maximum | 52 | 42 | 44 | |
| tensile | 57 | 48 | 49 | 46 |
| force (daN) | 58 | 57 | 59 | |

These results show that too high an energy causes excessive melting of the fibers 50 at their points of contact. This excessive melting occurs over a large part of the cross section of the fiber at the point of contact. Such melting provides the treated component with sufficient integrity so that it does not deform under gravity, however the strength of the component decreases.

During the tests carried out to obtain these results, electric arcs were observed between the electrodes when the voltage was raised in order to increase the energy stored in the capacitor. These electric arcs do not contribute to welding the fibers 50 together. This welding is in fact carried out by the flow of a current I through the metal fibers 50 with the points of contact melting simply owing to the Joule effect or by creation of a local arc. Consequently, the available energy is distributed between energy useful for the welding and energy lost by direct discharge in the gas between the electrodes 22, 24.

For an industrial machine, it is therefore preferable to have a capacitor of high capacitance, charged using a moderate voltage, so as to prevent the loss of energy by direct discharge in the gas between the electrodes 22, 24. In addition, this is in the direction of greater safety in an industrial environment in which high voltages are not desirable.

The components obtained by this process may be of varied shape, for example they may be parallelepipeds.

These varied shapes may require the use of several pairs of electrodes of opposite polarity, supported by the opposing walls of the mold, whether they be fixed or movable.

If the porosity of the components 100 is lower (for example 80%), the points of contact are more numerous and the energy needed to produce the welds is higher and may reach several kJ/cm2.

The above description mentions only one discharge capacitor 30. However, it is obvious to a person skilled in the art that a bank of several capacitors 30 may be used to implement the process according to the invention.

What is claimed is:

1. A process for forming metal components of controlled porosity by welding, comprising the successive steps of:

preparing a predetermined amount of metal elements of anistropic geometrical shape, intended for constituting a component;

distributing this predetermined amount of metal elements in a mold having at least one movable part;

exerting pressure using a movable part of the mold controlled by an external means, in at least one main direction on this predetermined amount of metal elements, said pressure being intended to reinforce and maintain the points of contact between these elements;

simultaneously passing an electric current through this predetermined amount of metal elements via a set of two electrodes of opposite polarity in order to join these metal elements together by welding, said two electrodes being placed so that the direction of flow of the current is overall coaxial with said main direction of the pressure exerted on the predetermined amount of metal elements; and removing the component from the mold; characterized in that:

the predetermined amount of metal elements is obtained by weighing a mass of metal elements whose value M is defined as a function of the desired degree of porosity $\tau$, the volume of the component Vc and the density of the metal alloy used $\rho a$ by the formula:

$$M=VC\ \rho a(1-\tau)$$

the predetermined amount of metal elements is distributed isotropically in the mold;

the pressure exerted is progressively increased until the component has the required shape, thus giving the component the desired level of porosity; and the movable part of the mold is then held in position and, simultaneously, the electric current flows through the metal elements and welds them together by local melting at the points of contact due to the Joule effect or by creation of a local arc.

2. The process as claimed in claim 1, characterized in that the elements of anisotropic geometric shape of the invention are fibers.

3. The process as claimed in claim 2, characterized in that the fibers are obtained by the technique of casting them on a wheel.

4. An apparatus for implementing the process according to claim 1, comprising a mold (10) with at least one movable wall (14), characterized in that each movable wall may be moved parallel to itself by an external means so as to apply an increasing pressure on the metal elements up to a particular position in which the wall is held in position during the welding operation.

5. The apparatus as claimed in claim 4, characterized in that the external means employed for each movable wall is an actuator servocontrolled in terms of force and then of position.

6. The apparatus as claimed in claim 4, characterized in that the electrodes are fastened to at least one movable wall.

7. The apparatus as claimed in claim 5, characterized in that the electrodes are fastened to at least one movable wall.

8. The process of claim 1, wherein the movable part comprising an electrode.

* * * * *